US005821465A

United States Patent [19]

Tanaka et al.

[11] Patent Number: 5,821,465

[45] Date of Patent: Oct. 13, 1998

[54] JOINT SECTION BETWEEN FLAT CABLE AND LEAD WIRES

[75] Inventors: Yoshiyuki Tanaka; Masataka Suzuki; Hiroyuki Ashiya; Nobuyuki Tsujino; Hidehiro Ichikawa, all of Shizuoka, Japan

[73] Assignee: Yazaki Corporation, Tokyo, Japan

[21] Appl. No.: 653,274

[22] Filed: May 23, 1996

[30] Foreign Application Priority Data

May 26, 1995 [JP] Japan ..... 7-128423
Feb. 2, 1996 [JP] Japan ..... 8-017554

[51] Int. Cl.[6] ..... H01R 4/02

[52] U.S. Cl. ..... 174/88 R; 174/117 F

[58] Field of Search ..... 174/84 R, 117 F, 174/84 S, 88 R; 439/77, 492, 499, 497, 874, 875

[56] References Cited

U.S. PATENT DOCUMENTS

| | | | |
|---|---|---|---|
| 3,115,541 | 12/1963 | Hanner et al. | 174/88 R X |
| 3,737,833 | 6/1973 | Jerominek | 439/77 X |
| 3,852,517 | 12/1974 | Fava | 174/88 R X |
| 4,085,502 | 4/1978 | Ostman et al. | 174/88 R X |
| 4,813,128 | 3/1989 | Massopust | 174/84 R X |
| 4,945,192 | 7/1990 | Urushibata et al. | 174/88 R X |
| 4,949,454 | 8/1990 | Schauer et al. | 439/492 X |
| 4,952,256 | 8/1990 | Schauer et al. | 174/84 R X |
| 4,963,699 | 10/1990 | Urushibata et al. | 174/88 R |
| 5,057,650 | 10/1991 | Urushibata et al. | 174/88 R |
| 5,212,348 | 5/1993 | Gibson | 174/117 F X |

FOREIGN PATENT DOCUMENTS

| | | | |
|---|---|---|---|
| 1192637 | 8/1985 | Canada | 174/117 F X |
| 0 337 400 | 10/1989 | European Pat. Off. . | |
| 3738204 | 5/1989 | Germany | 174/84 R X |
| 4-24611 | 6/1992 | Japan . | |
| 1407513 | 9/1975 | United Kingdom . | |

*Primary Examiner*—Dean A. Reichard
*Attorney, Agent, or Firm*—Armstrong, Westerman, Hattori, McLeland & Naughton

[57] ABSTRACT

A joint section is provided which connects a flat cable having a plurality of conductive lines with a plurality of lead wires to a plurality of joint terminals. A first end of each of the joint terminals is formed in compliance with a pitch between the two adjacent conductive lines and the second end of the joint terminals is formed in compliance with a pitch between two adjacent lead wires. Each conductive line is held between the first end of the corresponding one of the joint terminals and an auxiliary terminal placed on the conductive line and connected by a welding operation. The second end of the joint terminal is connected with a conductor of the corresponding one of the lead wires.

8 Claims, 19 Drawing Sheets

JOINT SECTION BETWEEN FLAT CABLE AND LEAD WIRES

BACKGROUND OF THE INVENTION

1. Field of the Invention

The present invention relates to a joint section for connecting a flat cable with a plurality of lead wires by use of a joint terminal or the like, and also to a method for a construction thereof.

2. Description of the Prior Art

Generally in a signal transmission system for a steering mechanism in an automobile, the signal received from a flat cable (hereinafter may be referred to just as "FFC"), which is wound around a rotative body, is transmitted outward by way of an electric wire. Since the FFC is made of a plurality of extremely thin (electrically conductive) copper foils with their opposite surfaces covered with a resilient thin resin film, each of the copper foils (herein after just referred to conductive lines) is extremely fragile to an external force and a pitch between the adjacent conductive lines is substantially narrow, so that it is quite difficult to directly connect them with other external lead wires.

In view of these defects, there has been provided a joint section as disclosed in Utility Model Publication No. Heisei 4-24611, wherein as shown in FIGS. 24 and 25A to 25C, a plurality of conductive lines of an FFC and a plurality of lead wires respectively corresponding to each of the conductive lines are welded by an ultra-sonic wave welding method by way of a plurality of joint bars (busbars) which are held in an electrically insulating body, and the thus welded joint sections are molded with an insulating resin by a mold inserting operation applied over the insulating layers of the FFC and of the lead wires.

In the Figures, reference numeral 51 denotes a first housing as a stator and 52 denotes a second housing as a rotor, wherein these housings form a concentric circle and are arranged to be rotatable with respect to each other, and also accommodate a flat cable 54 in a spiral form within a ring like chamber formed therebetween. One end of the flat cable 54 is fixed to the first housing 51 side, whereas the other end is fixed to the second housing 52 side.

Each of the conductive lines 54*a* exposed at one end of the flat cable 54 is welded to one end of the corresponding one of the joint bars 55. These joint bars 55 are mutually communicated in advance by an insulating holder 56 in compliance with the pitch between the two adjacent conductive lines of the flat cable 54, and each of the joint bars 55 is welded to the corresponding one of the lead wires 57 at the other end thereof. The joint section of the joint bars 55 respectively at one end with the conductive lines of the flat cable and at the other end with the lead wires is comprehensively protected by a resin molded cover 58 even covering over the respective insulating layers 54*b* and 57*b*.

In the above method for forming the joint section between the FFC and the lead wires, each of the conductive lines is directly connected with the corresponding one of the lead wires, and thus as shown in FIG. 26, the exposed thin conductive lines 54*a* of the FFC 54 should be handled with care, a deterioration of the conductive lines on connection and/or after connection or application of stress thereto should be avoided, and in addition, there are such problems that the connecting operation is quite difficult, and the reliability in their electrical and mechanical connections is not high enough. In other words, as shown in a magnified sectional view of a joint section between the FFC and the joint bars in FIG. 27, the welding marks left by the welding operation can be observed here and there, or as shown in FIG. 28, the tension and/or bending force is likely to be applied to produce a stress concentrated on to the joint section 59', thereby to deteriorate the FFC 54, so that a stable electrical and mechanical connection cannot be obtained.

Further, if the rotative mechanism of a signal transmitting apparatus for a steering mechanism is of a spiral type as mentioned before, the thickness of each of the conductive lines of FFC comes up to 100 $\mu$m or the like in consideration of its resistance value. Accordingly, even if a horn of an ultra-sonic wave welding machine is directly attached to the conductive lines of the FFC for its welding operation, the rigidity of each conductive line itself is not deteriorated, and thus even though an insert molding operation is applied thereto with an insulating resin material, the joint section between each conductive line of the FFC and the corresponding one of the joint bars is rarely disconnected from each other thereafter.

However, if the rotative mechanism is of a reverse rotation type, the thickness of the FFC is approximately only 30 $\mu$m, which is just one third of the spiral type mechanism. Accordingly, if the horn is attached thereto, the conductive lines can be damaged because of a vibration, and in addition, if an insert molding operation is comprehensively applied thereto, the possibility of disconnection of the joint section between the joint bars and the conductive lines will be greatly increased.

The present invention is made to overcome the above disadvantages, and it is an object of the present invention to provide a joint section of a plurality of conductive lines of a flat cable and respectively corresponding lead wires, which is capable of protecting a welded portion and whose electrical and/or mechanical connection is highly reliable, providing a good operability for the later processes by converting each conductive line of a flat cable to a connection terminal.

The further object of the present invention is to provide a joint section between a flat cable and a plurality of lead wires, which is applicable even to an extremely thin conductive line of 30 $\mu$m of a flat cable.

SUMMARY OF THE INVENTION

In order to accomplish the above object, a joint section connecting a flat cable having a plurality of conductive lines with a plurality of lead wires by way of a plurality of joint terminals according to the present invention is, constructed such that one end of the respective joint terminals is formed in compliance with a pitch between the mutual adjacent conductive lines, and the other side formed in compliance with a pitch between the mutually adjacent lead wires, wherein each conductive line of the flat cable is welded in such a state that it is intersected between one end of the corresponding one of the joint terminals and an auxiliary terminal placed on the conductive line, and the other end of each joint terminal is connected with the conductor of the corresponding one of the lead wires.

In the above structure, an insulating layer is left at the tip end of the portion of the respective conductive lines of the flat cable which is covered with an insulating layer. The conductive lines are linked mutually by the insulating layer, and intersected by the one end of the joint terminals and the auxiliary terminal, and the joint section connecting the flat cable and the lead wires by way of the joint terminal and the auxiliary terminal is comprehensively covered by an insert molding operation over the insulating layers of the flat cable and the lead wires at the opposite ends thereof.

The joint terminal can be formed in an L-shape which is composed of a flat face terminal section at one end to be welded to the conductive lines of the flat cable, and a circuit board connecting terminal section at the other end which is vertically bent downward from the flat face terminal section, wherein the circuit board terminal section is connected with a corresponding one of the lead wires by way of a pattern formed on the circuit board.

Further, a joint section connecting a flat cable having a plurality of conductive lines with a plurality of lead wires, comprises: a plurality of joint terminals whose respective one end is formed in compliance with a pitch between the adjacent conductive lines of the flat cable, and the other end is formed in compliance with a pitch between the adjacent lead wires; an auxiliary terminal holder which is formed by mutually connecting a plurality of auxiliary terminals by an insulating body in compliance with a pitch between the conductive lines; a casing which is provided with a holder accommodating section at one end, and a joint terminal placing section and a lead wire locking section at the other end individually; wherein each of the conductive lines at one end of the flat cable is welded in such a state that it is intersected between one end of the corresponding one of the joint terminals and corresponding one of the auxiliary terminals of the auxiliary terminal holder, and accommodated within the casing, and the conductor locked at a lead wire locking section of the casing are connected with the other end of corresponding one of the joint terminals.

In this case, it will be preferable that a mutual joint section of the flat cable, joint terminal auxiliary terminal and the lead wire is coated comprehensively by an insert molded body together with the casing, including the insulating layers of the flat cable and the lead wires.

Further, it can be constructed such that the joint section between the joint terminals and the conductive lines of the flat cable and between the joint terminals and the conductor of the lead wires are accommodated to be fitted and intersected by an upper casing and a lower casing, which upper and lower casings have a mutual coupling means.

Still further, the joint section for connecting a flat cable having a plurality of conductive lines with a plurality of lead wires can be constructed such that it comprises: a plurality of joint terminals, whose respective one end is formed in compliance with a pitch between two adjacent conductive lines of the flat cable, and the other end formed in compliance with a pitch between two adjacent lead wires; an auxiliary terminal holder which is formed by mutually connecting a plurality of auxiliary terminals by an including body in compliance with a pitch between the adjacent conductive lines, and an upper casing and a lower casing provided respectively with a holder accommodating section at one end thereof and a lead wire accommodating section at the other, and also having a mutual coupling means, wherein each conductive line of the flat cable is welded in such a state that it is intersected between one end of the corresponding one of the joint terminals and the corresponding one of the auxiliary terminals mutually, and the conductor of the respective lead wires are welded to the other end of the joint terminals on the same surface side where the conductive lines of the flat cable are welded and intersected between the upper casing and the lower casing.

The method for forming a joint section between a flat cable having a plurality of conductive lines and a plurality of lead wires by use of a terminal plate composed of a plurality of joint terminals is characterized in that one end of the respective joint terminals is aligned with a pitch between the adjacent conductive lines, and the other end being aligned with a pitch between the adjacent lead wires, which other end being communicated with each other by a link belt, can have the steps of: intersecting one end of each of the conductive lines between one end of the corresponding one of the joint terminals and an auxiliary terminal to apply welding operation thereto; cutting away the link belt and welding the cut and separated other end of the joint terminals to the conductor of the respectively corresponding lead wires.

In this method, it will be preferred to further include the steps of: after welding the conductor of the lead wires, comprehensively coating the joint section between the flat cable and the lead wires made by the joint terminals and the auxiliary terminal over the insulating layers of the respective flat cable and the lead wires by an insert molding operation.

The method for forming a joint section between a flat cable having a plurality of conductive lines and a plurality of lead wires by, use of a terminal plate composed of a plurality of joint terminals, one end of each being aligned with a pitch between the adjacent conductive lines, and the other end being aligned with a pitch between the adjacent lead wires, which other end being communicated with each other by a link belt, is characterized in that it comprises the steps of: intersecting one end of each of the conductive lines between one end of the corresponding one of the joint terminals and an auxiliary terminal to apply welding operation thereto; cutting away the link belt; welding the conductor of the respective lead wires to the other end of the joint terminals on the same surface side where the conductive lines of the flat cable are welded; accommodating fittedly the joint section to either an upper casing or lower casing; and superposing these casings one on the other for firmly coupling to each other.

In accordance with an aspect of the present invention, since each of the conductive lines of the flat cable is converted to a connection terminal by the auxiliary terminal and the joint terminals, the later operability including a connection with a plurality of lead wires can be improved. Further, as the conductive lines are intersected by the joint terminals and the auxiliary terminal to be welded, they can be securely protected, whereby a reliability of their electrical and/or mechanical connection can also be greatly raised.

In accordance with an aspect of the present invention, since the insulating layers are left at the tip end portion of the respective conductive lines of the flat cable, they can still be integrally connected, and thus thin conductive lines will not likely to be bent, raising thereby an easy operability.

In accordance with an aspect of the present invention, since the joint section between the flat cable and the lead wires is formed by an insert molding operation over the respective insulating layers of the flat cable and of the lead wires, the reliability thereof can be raised.

In accordance with an aspect of the present invention, the above joint terminal can be formed as an L shape to be directly connected with a printed circuit, so that a variety of modifications and applications can be made possible.

In accordance with an aspect of the present invention, since the auxiliary terminals are mutually communicated by an insulating body and formed in compliance with the pitch between the adjacent conductive lines so as to form an auxiliary terminal holder mutually, the mechanical strength of the joint section between the joint terminals and the lead wires can be greatly increased as well as its operability. In addition, as the joint section between the joint terminals and the conductive lines and also between the joint terminals and the lead wires are accommodated in a casing, the electrical and/or mechanical connection thereof can be stabilized, whereby it can be applied even to a reverse rotation type mechanism of approximately 30 $\mu$m of thickness.

In accordance with an aspect of the present invention, since the entire joint section can be comprehensively coated by an insert molding method, its reliability is increased.

In accordance with an aspect of the present invention, since the joint section is intersected by the upper and lower casings, and these casings are fixedly interposed one on the other by a fixing means, the operability thereof is substantially improved compared with an insert molding operation.

In accordance with the aspect of the present invention, the conductive lines of the flat cable and the lead wires are respectively welded to the same side surface of the joint terminals, the other side surface of the respective joint terminals is not connected with either the conductive lines or the lead wires. In addition, since the joint section is intersected by the upper casing and the lower casing, a molding force is not applied to the joint section when applying a molding operation thereto.

In accordance with an aspect of the present invention, since the connection between the conductive lines of the flat cable and the lead wires is conducted such that one end of the respective conductive lines of the joint terminals is aligned with the pitch between the adjacent conductive lines, while the other end is aligned with the pitch between the adjacent lead wires, the other end is integrally connected by a link belt, and the mutual positioning can be properly and readily operated. Further, since the conductive lines of the flat cable are intersected by the joint terminals and the auxiliary terminals before welding, the mechanical and/or electrical stability thereof can be obtained.

In accordance with the method of the present invention, since, after the connection of the lead wires, the joint section between the conductive lines of the flat cable and the lead wires by way of the joint terminals and the auxiliary terminals can be comprehensively coated over the insulating layers of the respective flat cable and the lead wires by an insert molding operation, the reliability thereof can be greatly improved.

In accordance with the method of the present invention, since one end of the respective joint terminals is aligned with the pitch between the adjacent conductive lines, and the other end aligned with the pitch between the adjacent lead wires, the mutual positioning operation can be made easier. In addition, since the conductive lines of the flat cable are intersected between the joint terminals and the auxiliary terminals before welding, the three-layer structure is welded to make the joint section mechanically and electrically stabilized. Further, since the conductor of the respective lead wires are welded to other ends of the joint terminal and also on the same surface of the conductive lines of the flat cable, and fixedly accommodated in one of the upper and the lower casings and intersected by these casings, there casings can intersect the joint section in a constant one assembly line, which is easier and more stable than the process in which the joint section is molded by an insert molding operation.

Other features and advantages of the invention will be apparent from the following description taken in connection with the accompanying drawing.

BRIEF DESCRIPTION OF THE DRAWINGS

FIG. 1A is a plain view showing a constructing process of a joint section according to a first embodiment of the present invention, while

FIG. 3A is a plain view of a second embodiment of the present invention, while

FIG. 4A is a plain view showing a constructing process of a joint section according to a third embodiment of the present invention, while

FIG. 5A is a plain view of the last constructing process of the same, while

FIG. 6A is a sectioned plain view showing a constructing process of a joint section according to a fourth embodiment of the present invention, while

DETAILED DESCRIPTION OF THE PREFERRED EMBODIMENTS

Various embodiments of the present invention will now be explained with reference to the figures.

Figure 1A:
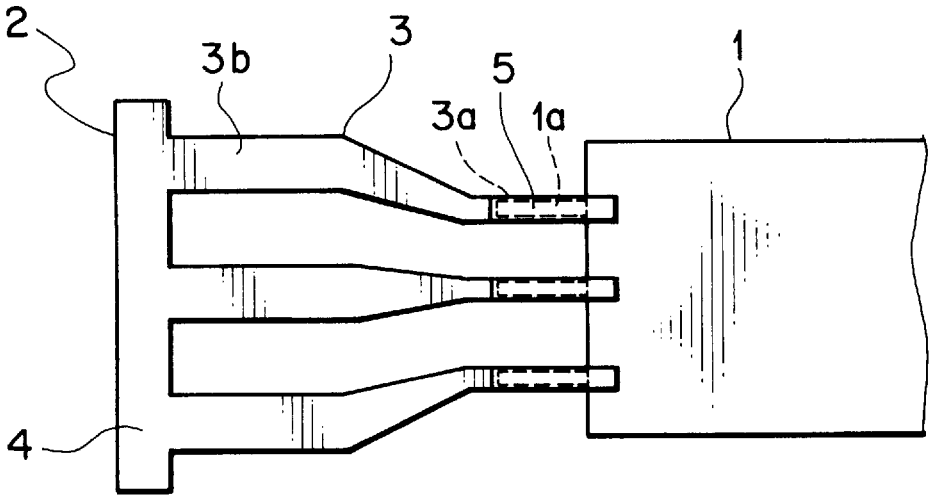
Figure 1B:
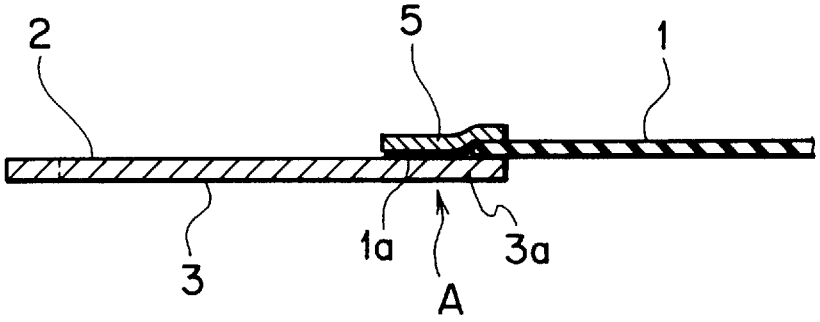
FIG. 1B is a sectional view thereof.
Figure 2:
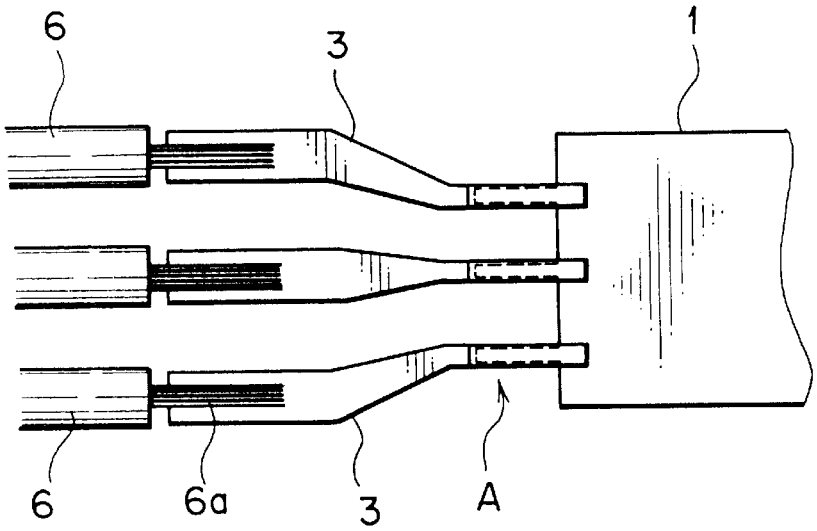
FIG. 2 is a plain view of the last constructing process of the same.

FIGS. 1A, 1B and FIG. 2 show a first embodiment of the present invention, wherein reference numeral 1 denotes a flat cable, numeral 2 denotes a terminal plate, 5 an auxiliary terminal, 6 a lead, and reference character A denotes a joint section.

In the figures, the terminal plate 2 is composed of a plurality of joint terminals 3 and a link belt 4 communicating each of these joint terminals, wherein one end 3*a* of the respective joint terminals 3 is formed to the same width as that of the each conductive line 1*a* of the flat cable 1, and also aligned at the same pitch of these adjacent conductive lines 1*a*, while the tip end of the other end 3*b* thereof is integrally connected with the link belt 4. This terminal plate 2 is formed by press molding an electrically conductive metal plate of copper, copper alloy or the like, and the auxiliary terminal 5 is also formed by a press molding operation, having the same width as that of the conductive line 1*a*.

The above joint section A is formed by, first, as shown in FIGS. 1A and 1B, putting the terminal plate 2 on a jig (not shown), superposing the conductive lines 1*a* of the flat cable 1 onto the end portion 3*a* of each of the joint terminals 3, and then further putting the auxiliary terminals 5 thereon and welding the thus formed three-layer structure by an ultra-sonic wave welding method. It is to be noted that the connecting method can be replaced by a heat welding, spot welding, soldering or any other known method.

After the welding operation, the link belt 4 of the terminal plate 2 is cut away, and as shown in FIG. 2, the other end 3*b* of each joint terminal 3 is connected with the lead wires 6*a* of each of the lead lines 6. The connection can be made by soldering, as well as the above-mentioned other known means such as the ultra-sonic wave welding, spot welding, pressure welding and so on.

As is clear from the above explained first embodiment, the joint section A is formed in such a mode that each exposed conductive line 1*a* of the flat cable 1 is vertically intersected by the joint terminal 3 made of an electrically conductive substance and the auxiliary terminal 5 so as to be welded, so that the conductive line la is converted to a connection terminal. In short, the conductive line 1*a* is reinforced by the joint terminal 3 and the auxiliary terminal 5, due to which the operability in the later processes like the above connecting operation of the lead wires 6*a* can be greatly improved as well as the reliability of the connection itself.

Figure 3A:
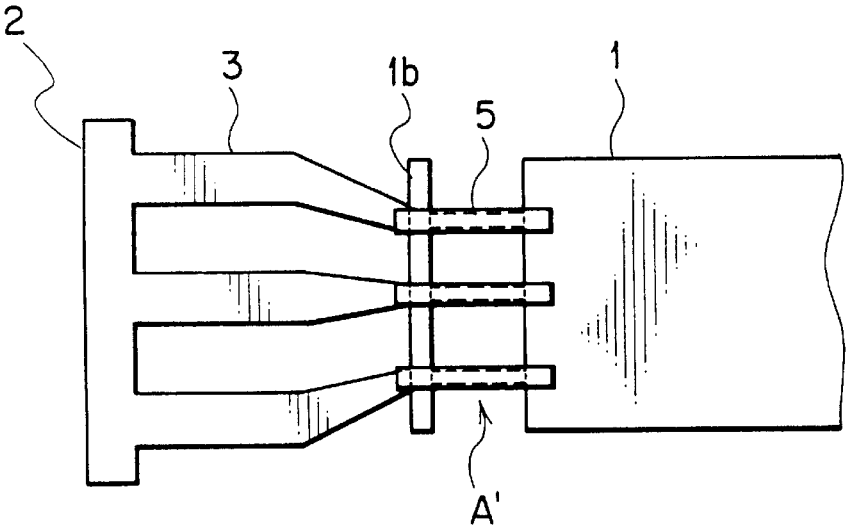
Figure 3B:
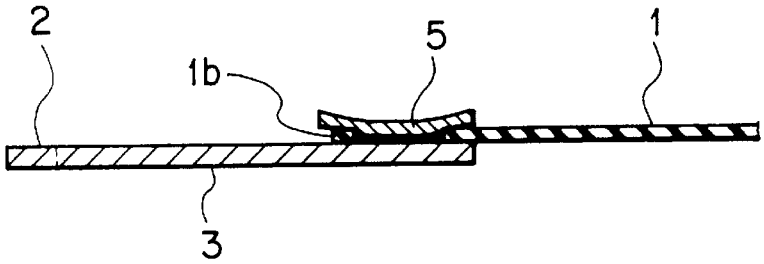
FIG. 3B is a sectional view thereof.
Figure 4A:
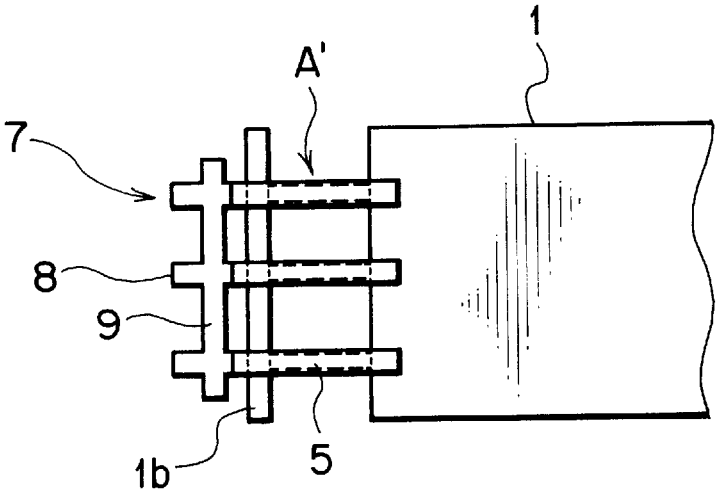
Figure 4B:
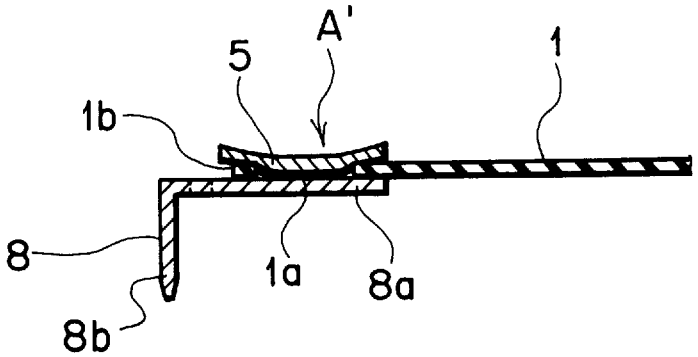
FIG. 4B is a sectional view thereof.
Figure 5A:
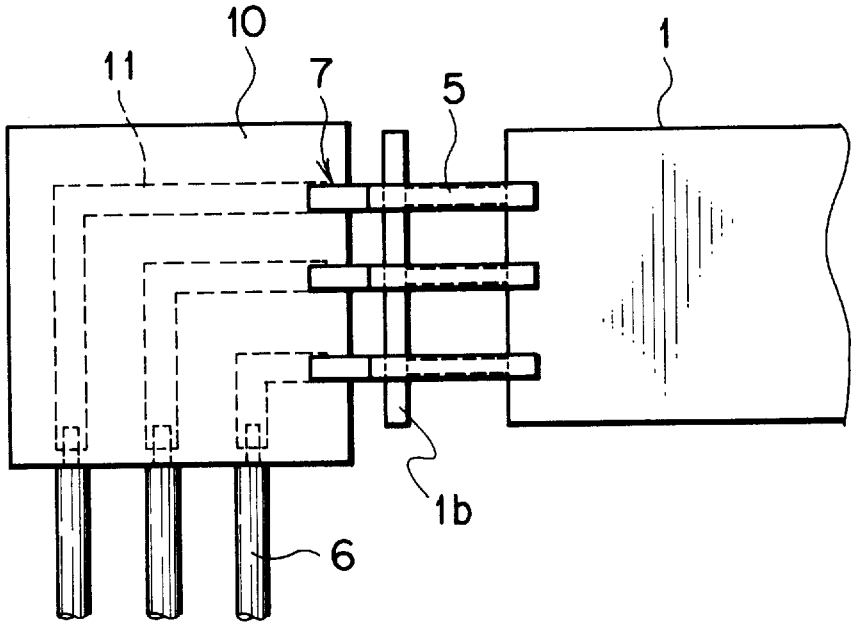
Figure 5B:
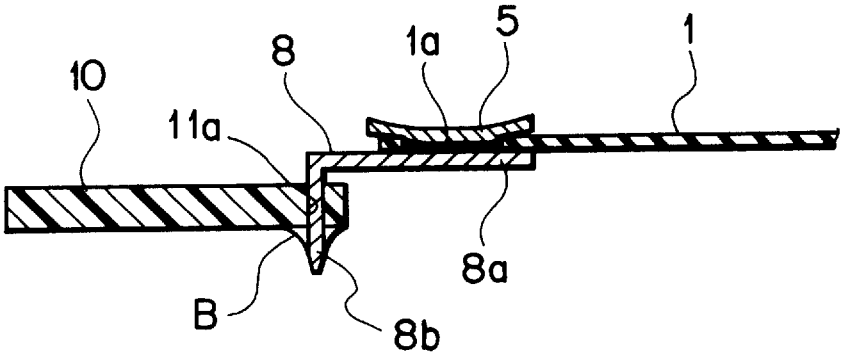
FIG. 5B is a sectional view thereof.

FIGS. 3A, 3B show a second embodiment of the present invention, which is different from the first embodiment only in that the joint section A' is constructed such that the conductive line 1*a* of the end portion of the flat cable 1 is intersected by the joint terminal 3 and the auxiliary terminal 5, but leaving the insulating layer 1*b* at the tip end thereof to be welded by an ultra-sonic wave welding method.

By leaving the insulating layer 1*b* at the tip end of the conductive line 1*a*, a plurality of conductive lines 1*a* are linked together, whereby each conductive line 1*a* is not readily bent individually due to which the operability thereof is improved. Besides, a stress applied to the conductive line 1*a* after the connection is reduced, and the reliability in the electrical and mechanical connection thereof can also be greatly improved.

FIGS. 4A and 4B and FIGS. 5A and 5B show a third embodiment of the present invention. In these figures, the terminal plate 7 is composed of a plurality of L-shape joint terminals 8 and a link belt 9 through which all the joint terminals 8 are linked altogether. Each of the L-shape joint terminals 8 is composed of a flat terminal section 8*a* and a circuit board connecting terminal section 8*b* which is bent vertically downward, and these terminals 8*a*, 8*b* are arranged in compliance with the pitch between the adjacent conductive lines 1*a* of the flat cable 1. Reference numeral 10 denotes a printed circuit board with a plurality of patterns 11 formed on it.

In this third embodiment, one end of the conductive line 1*a* of the flat cable 1 is, together with the insulating layer 1*b* formed at the tip end of the conductive line, intersected between the flat terminal section 8*a* of the L-shape joint terminal 8 and the auxiliary terminal 5, and is welded by an ultrasonic wave welding method to form a joint section A', which is same as the second embodiment.

Then, the terminal 8*b* of the L-shape joint terminal 8 is threaded through one of land holes 11*a* provided at one end section of the pattern 11 formed on the printed circuit board 10, and is soldered at the portion B by an automatic soldering machine or the like so as to connect one end thereof to the corresponding pattern 11, and thereafter the link belt 9 is severed away and finally the lead wires 6 are soldered and connected with the other end of the pattern 11.

Figure 6A:
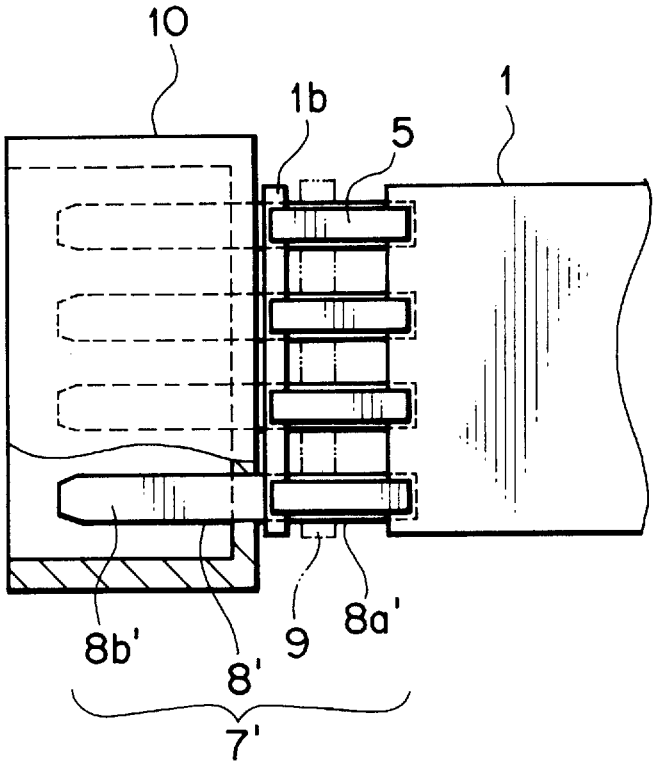
Figure 6B:
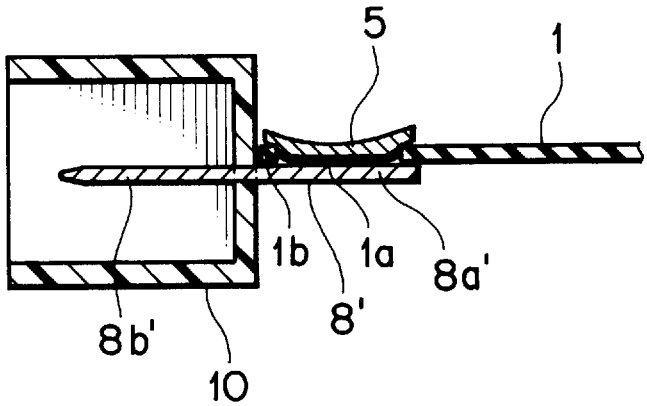
FIG. 6B is a sectional view thereof.

FIGS. 6A and 6B disclose a fourth embodiment in which the present invention is applied to the connection between a connecting terminal and a flat cable.

In the figure, the terminal plate 7' is composed by mutually connecting a plurality of flat joint terminals 8', each of which is provided with a flat terminal section 8*a*' at one end thereof and a connecting terminal section 8*b*' at the other, to the link belt 9 just as in the third embodiment.

In this embodiment, since the conductive line 1*a* of the flat cable 1 is made to be a connection terminal by a flat joint terminal 8' having a connecter section 8*b*', it can be handled just like a connecter terminal.

Figure 7:
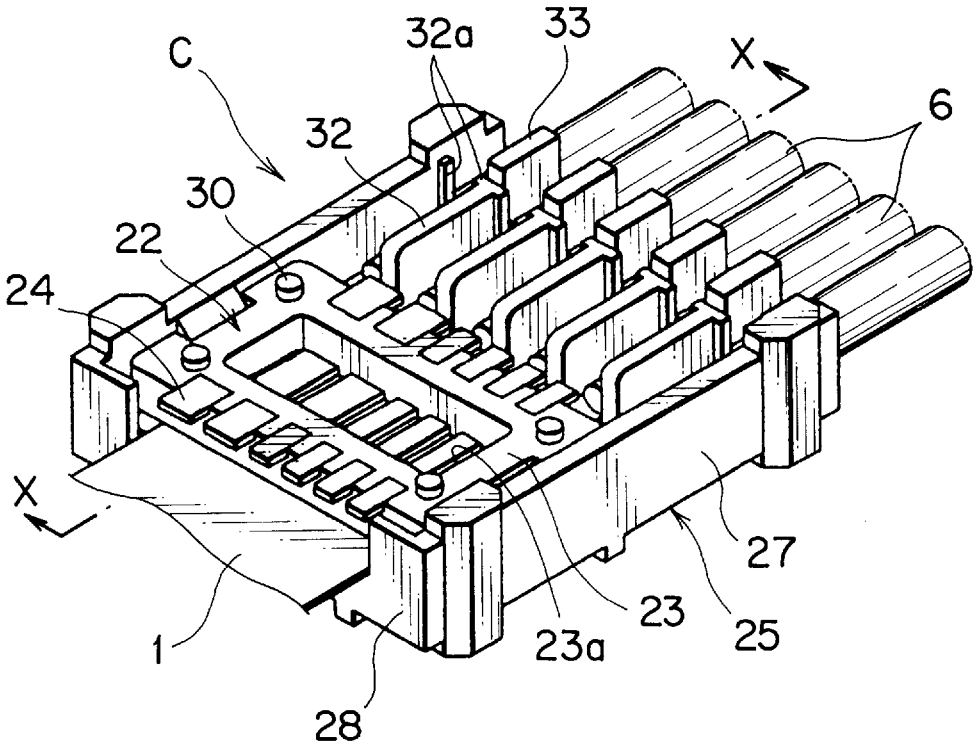
FIG. 7 is a perspective view showing a constructing process of a joint section according to a fifth embodiment of the present invention.
Figure 9:
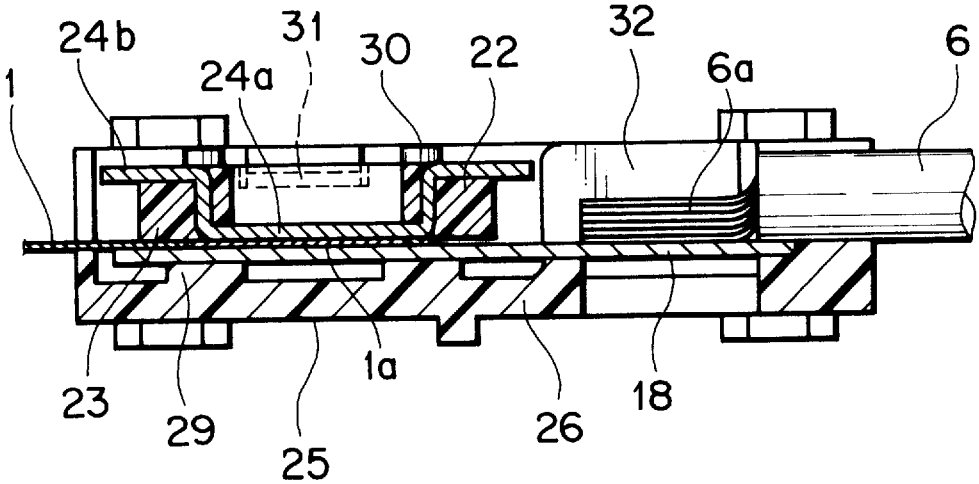
FIG. 9 is a sectional view observed along a line X—X of FIG. 7.
Figure 8:
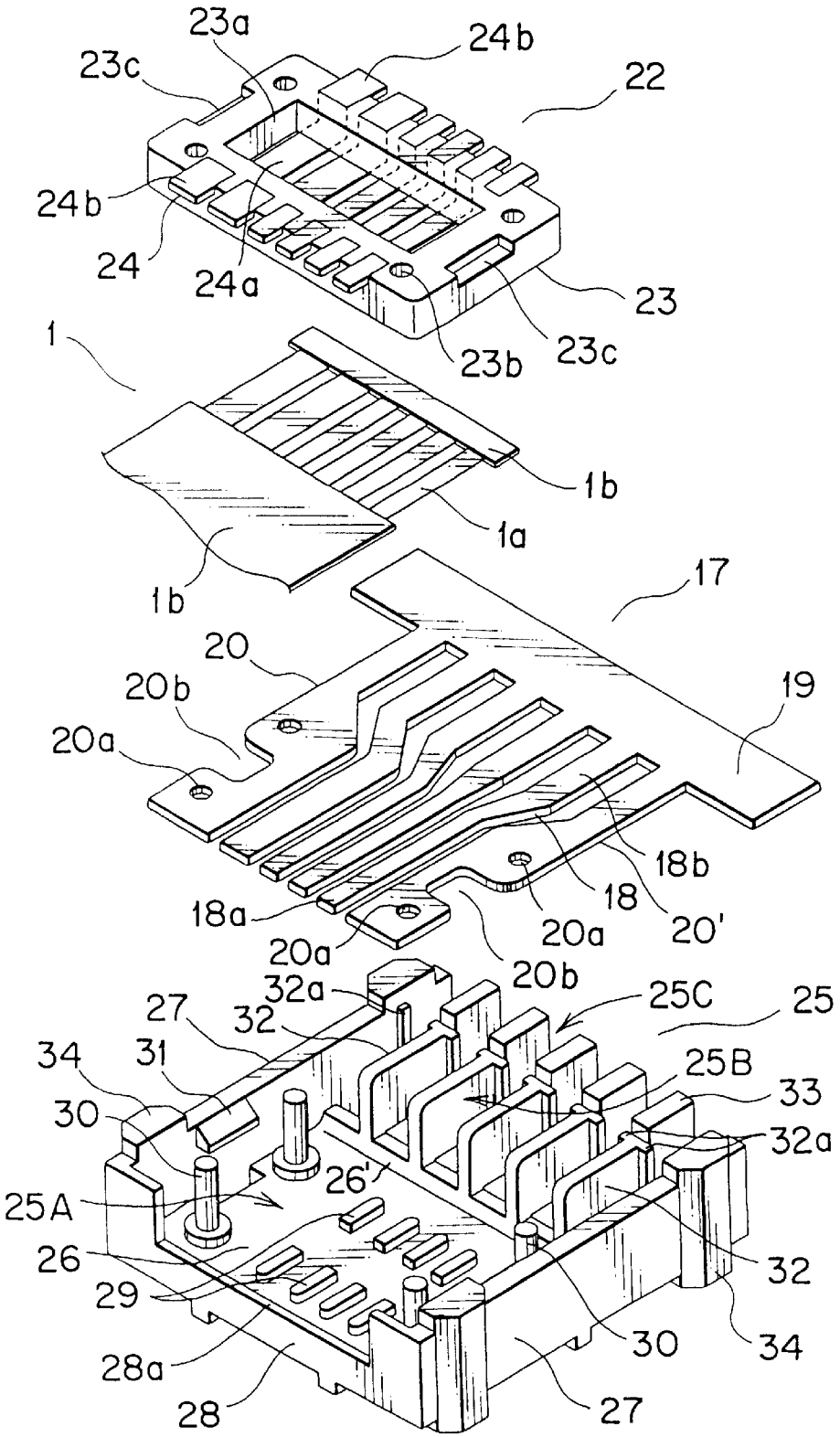
FIG. 8 is an exploded perspective view of FIG. 7.

FIG. 7 is a perspective view of a joint section showing a fifth embodiment of the present invention, FIG. 8 is an exploded perspective view thereof and FIG. 9 is a sectional view taken along with a line X—X of FIG. 7. In this fifth embodiment, the joint section C is composed of a flat cable 1, a terminal plate 17, an auxiliary terminal holder 22 and a casing 25.

The terminal plate 17 comprises a plurality of joint terminals 18, whose one end 18*a* is formed to the same width as that of the conducting lines 1*a* of the flat cable 1 and also aligned at the same pitch between these adjacent conductive lines, while the other end 18*b* is aligned at the same pitch between the adjacent lead lines 6, and is composed, as in the first embodiment, by mutually connecting the above other end 18*b* of the respective joint terminals 18 by way of a link belt 19, and also linking two other wide joint terminals 20, 20', each of which is provided respectively at the opposite outermost sides of the terminal plate 17, wherein a pair of pin through-holes 20*a* are formed in such a manner that one in the front and the other in the rear side intersecting a notch portion 20*b* therebetween.

The auxiliary terminal holder 22 is composed of an insulating frame body 23 and a plurality of auxiliary terminals 24 held by the frame body. The frame body 23 is a frame provided with an opening 23*a* for insertion and/or removal of a horn molding machine in the central portion thereof, having also a pin through-hole 23*b* at each corner corresponding to the four pin through-holes 20*a* of the terminal plate 17, and a locking recess 23*c* at the respective lateral shoulder portions. The auxiliary terminal 24 is composed of a flat connecting plate 24*a* and hook portions 24*b* at the opposite lateral sides thereof whose vertical level is higher than that of the flat connecting plate 24*a*, forming together a chair-like shape. The auxiliary terminals 24 are supported and fixed by the frame body 23 in compliance with the pitch between the adjacent conductive lines of the flat cable 1. It will be preferable if the auxiliary terminal holder 22 is formed in advance such that a plurality of auxiliary terminals 24 are aligned in a mold frame at a predetermined pitch and molded by an insert molding method in which insulating resin is injected thereto.

The casing 25 is formed as an open box without a rear side wall nor upper wall, by having only a bottom wall 26, lateral side walls 27, and a front wall 28 formed with a notched portion 28*a* therein, wherein it further accommodates inside the terminal plate 17, conductive lines 1*a* of the flat cable 1 and the lead lines 6. In the casing 25, there is formed a raised bottom portion 26' at the rear half thereof by way of a stepped section, whereby in the front half of the casing a holder accommodating section 25A is formed, while in the rear half a joint terminal placing section 25B and a lead wire locking section 25C are formed separately.

In the holder accommodating section 25A, a plurality of ribs 29 are protrudedly provided for respectively receiving the joint terminals 18 of the terminal plate 17 at the center portion of the bottom wall 26, while positioning pins 30 are mounted upright at the respective four corners, and locking projections 31 are protrudedly formed in the respective inner upper surface of the side walls 27.

In the joint terminal placing section 25B, a plurality of separating walls 32 are mounted upright in the raised bottom section thereof for separating the plurality of joint terminals 18 and a pair of outer joint terminals 20, 20' from one another, whereas the lead locking section 25C is structured by a plurality of higher walls 33 which are successively formed from the separating walls 32, and a pair of projecting walls 32*a* laterally protruding from the respective rear ends of each separating wall 32.

By the way, the side walls 27 of the casing 25 are each integrally formed with a pair of positioning ribs 34 at the front and rear ends thereof, so that the casing 25 can be easily set into a metal mold for a later insert molding operation.

Next, a method for constructing the joint section C is explained with reference to FIGS. 10 to 15.

Figure 10:
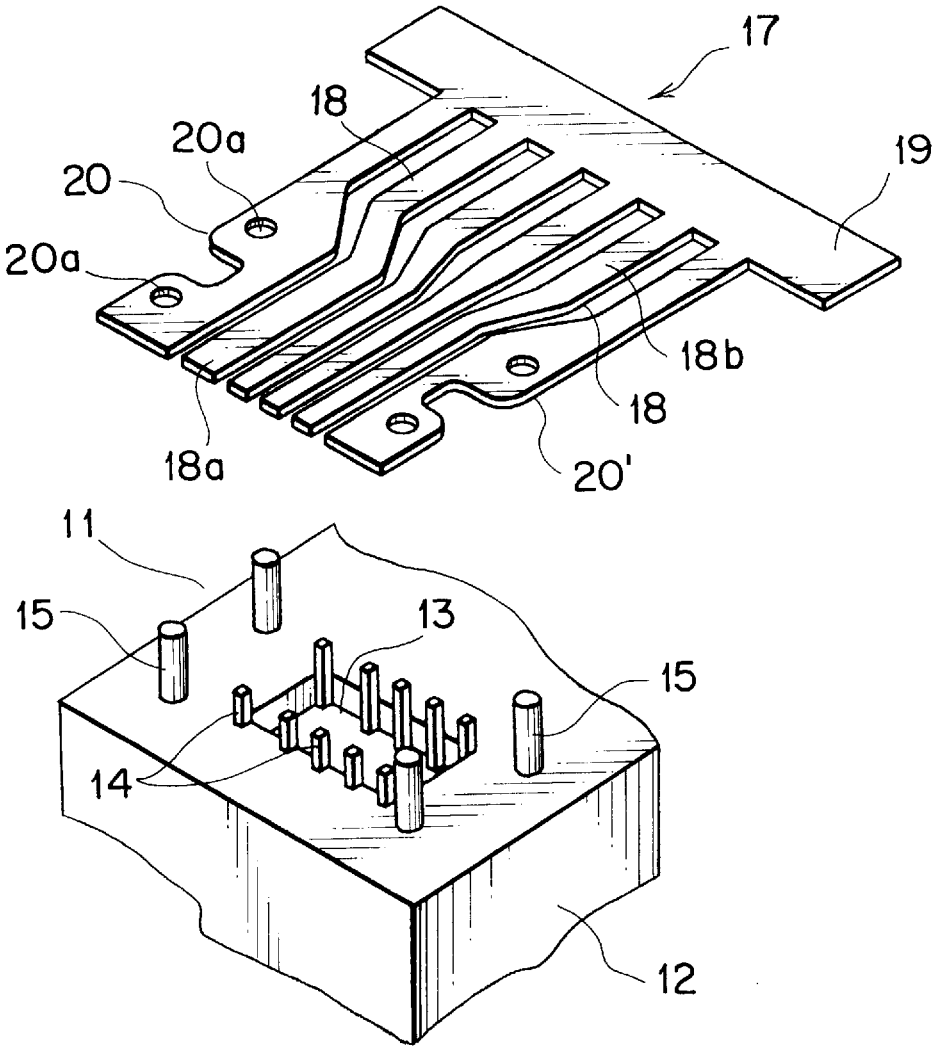
FIG. 10 is an explanatory view showing a constructing process of a joint section of FIG. 7.

In FIG. 10, reference numeral 11 denotes a jig used for forming the joint section, and in the center portion of the jig main body 12 there is formed an opening 13 through which a horn of an ultra-sonic wave welding machine (not shown) is inserted and/or removed, wherein the opening 13 is further formed with a plurality of auxiliary pins 14 for positioning the plurality of joint terminals 18 of the terminal plate 17 vertically protruding at the front and rear peripheral walls thereof, and also formed with four positioning pins 15 to be inserted into the pin through-holes formed in the terminal plate 17 and the auxiliary terminal holder 22.

With this construction above, at first, the terminal plate 17 is set on the jig 11, and then the positioning pins 15 are received by the pin through-holes 20*a* formed in the respective joint terminals 20 and 20' of the terminal plate 17. Then the end portion 18*a* of the respective joint terminals 18 are separated from each other by the corresponding auxiliary pins 14, so that the terminal plate 17 is properly positioned.

Figure 11:
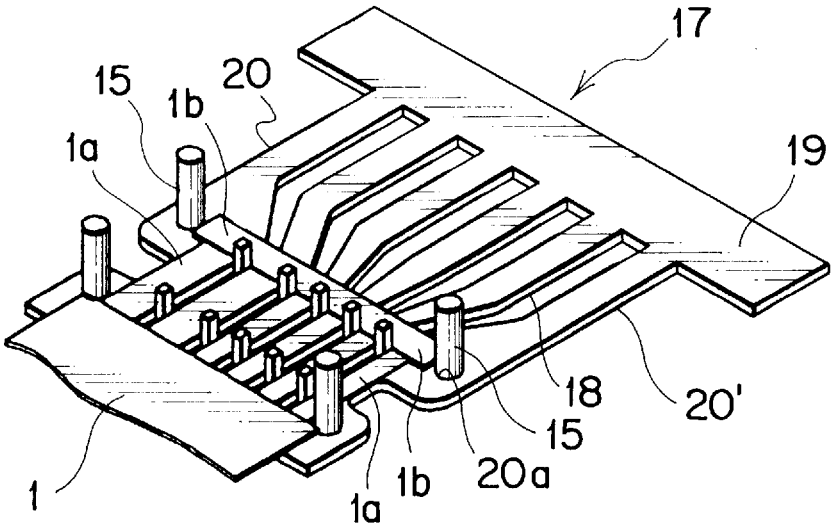
FIG. 11 is an explanatory view showing the next process of FIG. 10.

Thereafter, as shown in FIG. 11, the conductive lines 1*a* of the flat cable 1 are placed on each corresponding one end 18*a* of the joint terminals 18 (20, 20').

Figure 12:
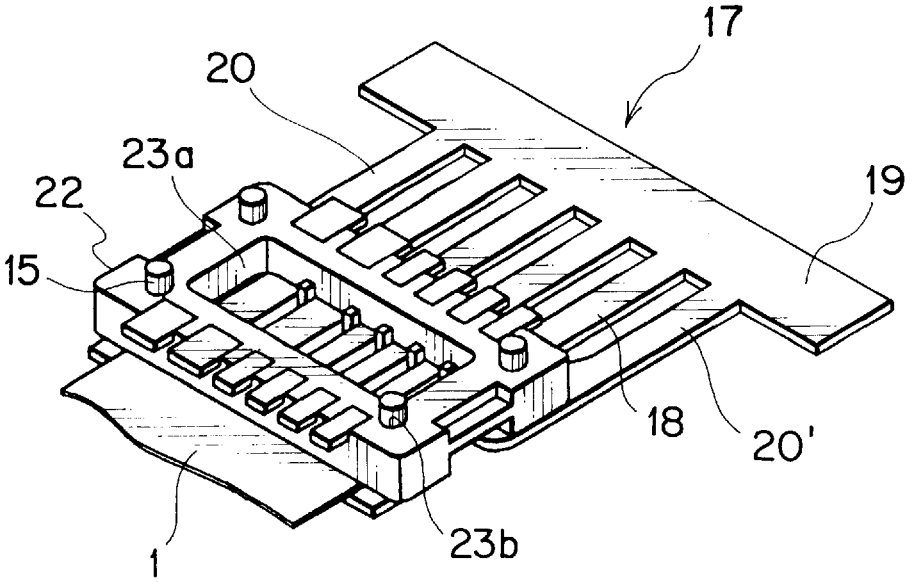
FIG. 12 is an explanatory view showing the next process of FIG. 11.

Further, as shown in FIG. 12, the auxiliary terminal holder 22 is placed on it, and the thus superposed portion is welded by an ultra-sonic wave welding machine through the vertically aligned openings 23*a* and 13. In other words, the auxiliary terminal holder 22 is correctly positioned by receiving the above positioning pins 15 into the pin through-holes 23*b* formed in the frame body 23, whereby each of the conductive lines 1*a* of the flat cable 1 is intersected by the connecting plate section 24*a* of the corresponding one of the auxiliary terminals 24 and one end 18*a* of the corresponding one of the joint terminals 18 (20, 20'), making a superposed three-layer structure, so that an ultra-sonic wave welding operation is applied as is done in the first embodiment.

Figure 13:
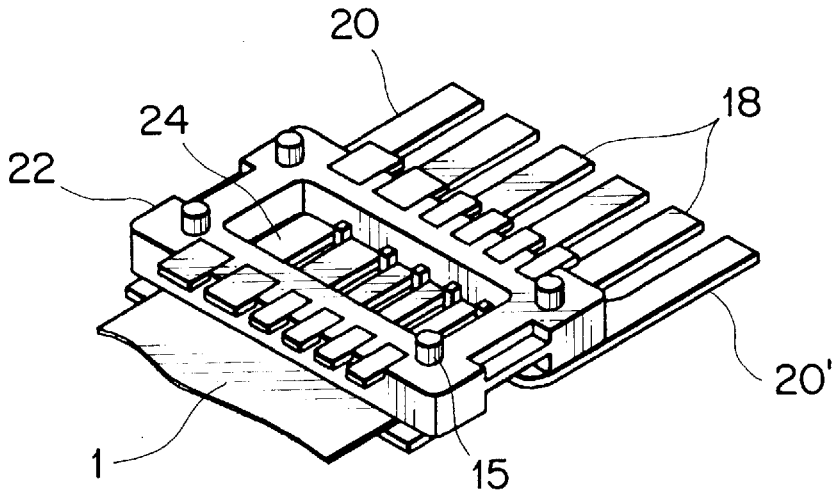
FIG. 13 is an explanatory view showing the next process of FIG. 12.

After that, as shown in FIG. 13, the link belt 19 of the terminal plate 17 is cut away. Since each of the conductive lines 1*a* of the flat cable 1 is connected with the connecting plate 24*a* which is insulatedly fixed by the frame body 23 of the auxiliary terminal holder 22, each conductive line 1*a* or the pitch between itself and another adjacent one of the conductive lines 1*a* will never be instable.

Figure 14:
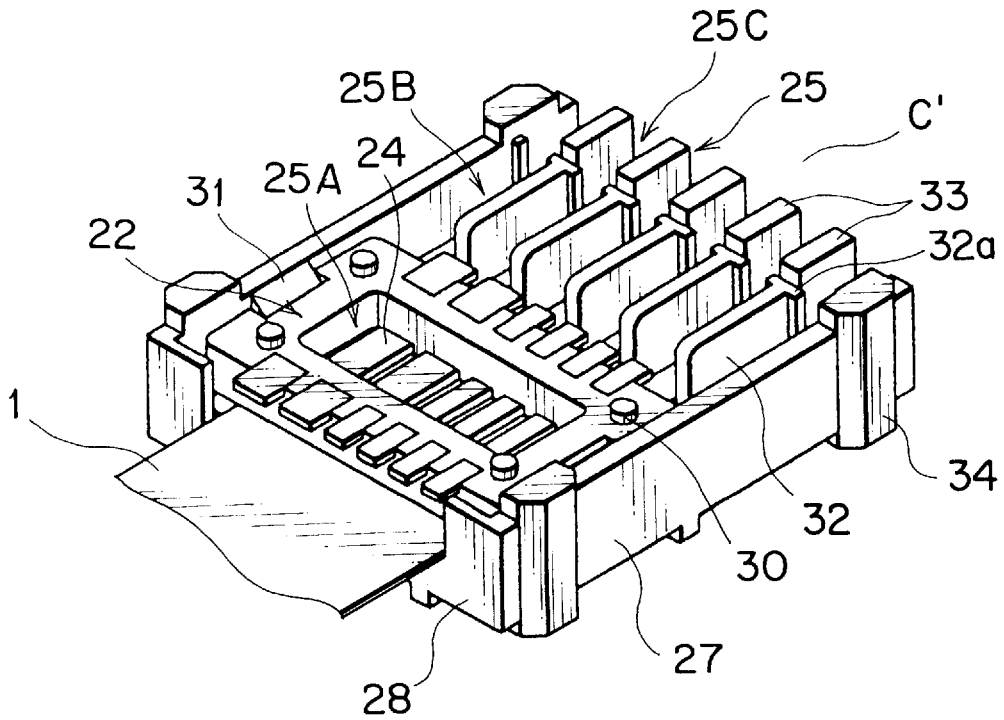
FIG. 14 is an explanatory view showing the next process of FIG. 13.

After the above process, as shown in FIG. 14 the joint section C' composed of the joint terminals 18, conductive lines 1*a* and the auxiliary terminal holder 22 are set to the casing 25. In other words, when the holder 22 is pushed into the holder accommodating section 25A of the casing 25 aligning the through-holes 23*b* of the auxiliary terminal holder 22 with the positioning pins 30, the locking projections 31 each provided on the inner surface of the respective side walls 27 are fitted with the locking recesses 23*c*, so that the terminal holder 22 is locked and fixed to the casing 25, and the other end 18*b* of each joint terminal 18 is placed on the raised bottom section 26' of the joint terminal placing section 25B, whereby each joint terminal 18 is separated from the others.

Next, in the lead locking section 25C, The respective lead wires 6 are pushed into the gap between the separating walls 33, 33 to be locked by the projecting walls 32*a*, 32*a*, and each conductive lead line 6*a* whose end portion is exposed is placed on the other end 18*b* of each joint terminal 18 to be welded by an ultra-sonic welding machine as above.

Figure 15:
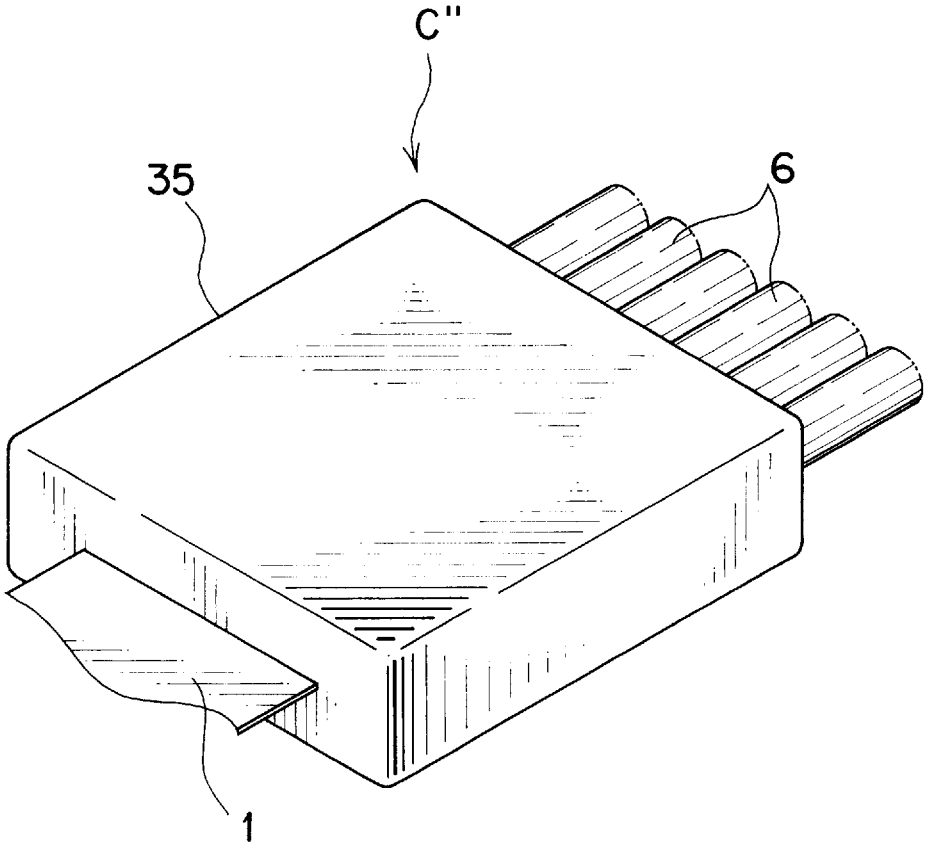
FIG. 15 is an explanatory view showing the last process of the same.

Finally, as shown in FIG. 15, the whole casing 25 including the insulating layer of the flat cable 1 and of the lead wires 6 is covered with an insert molded body 35 of insulating resin, and by this operation a resin-coated molded assembly C" of the joint section C between the flat cable 1 and the lead wires 6 is obtained.

In the insert molding operation, the conductive lines 1*a* of the flat cable 1 are reinforced, as mentioned before, by the auxiliary terminals 24 of the auxiliary terminal holder 22 and the joint terminals 18 (20, 20') separated from the terminal plate 17, and thus no member is damaged during the welding operation by an ultra-sonic wave welding machine, and therefore there will be no fear of disconnection due to a molding pressure of the insulating resin or the like.

Figure 16:
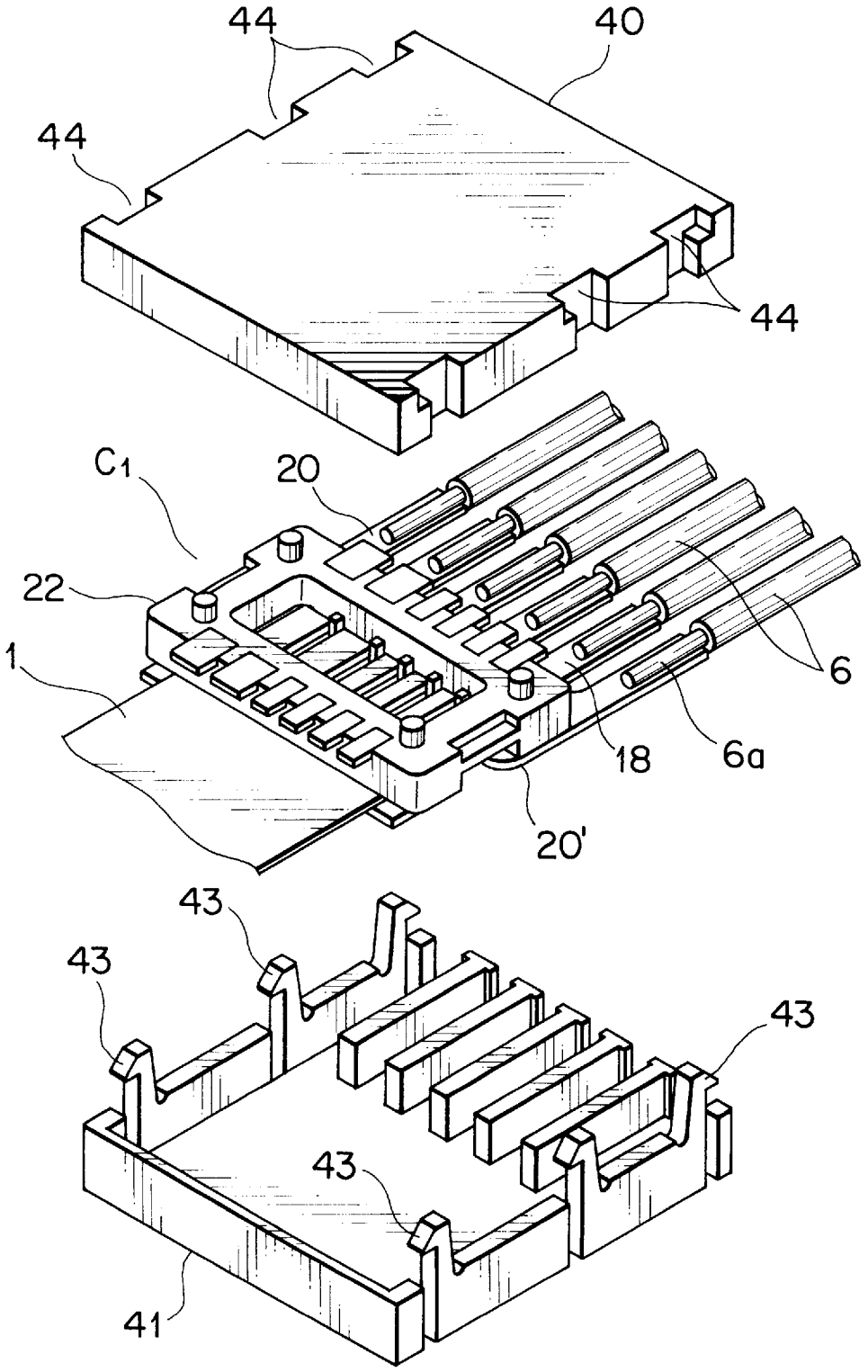
FIG. 16 is an exploded perspective view showing a joint section according to a sixth embodiment of the present invention.

FIG. 16 represents a joint section C1 of a sixth embodiment of the present invention.

In the same figure, the joint section C1 according to the sixth embodiment is composed of a flat cable 1, lead wires 6, joint terminals 18 (20, 20') and an auxiliary terminal holder 22. In short, each conductive line 1*a* of the flat cable 1 is intersected between one end 18*a* of the corresponding one of the joint terminals 18 (20, 20') and a connecting plate section 24*a* of the corresponding one of the auxiliary terminals 24, the superposed section is welded by an ultra-sonic wave welding machine, and the lead wires 6*a* of each of the lead wires 6 are welded in the same manner to the other end 18*b* of the corresponding one of the joint terminals 18 (20, 20'). Then, the joint section C1 is accommodated in the upper casing 40 and the lower casing 41 (later explained), thereby protected by being intersected between the casings.

Here, the method for covering the joint section C1 with the upper casing 40 and the lower casing 41 to be protected therein will now be explained.

Figure 17:
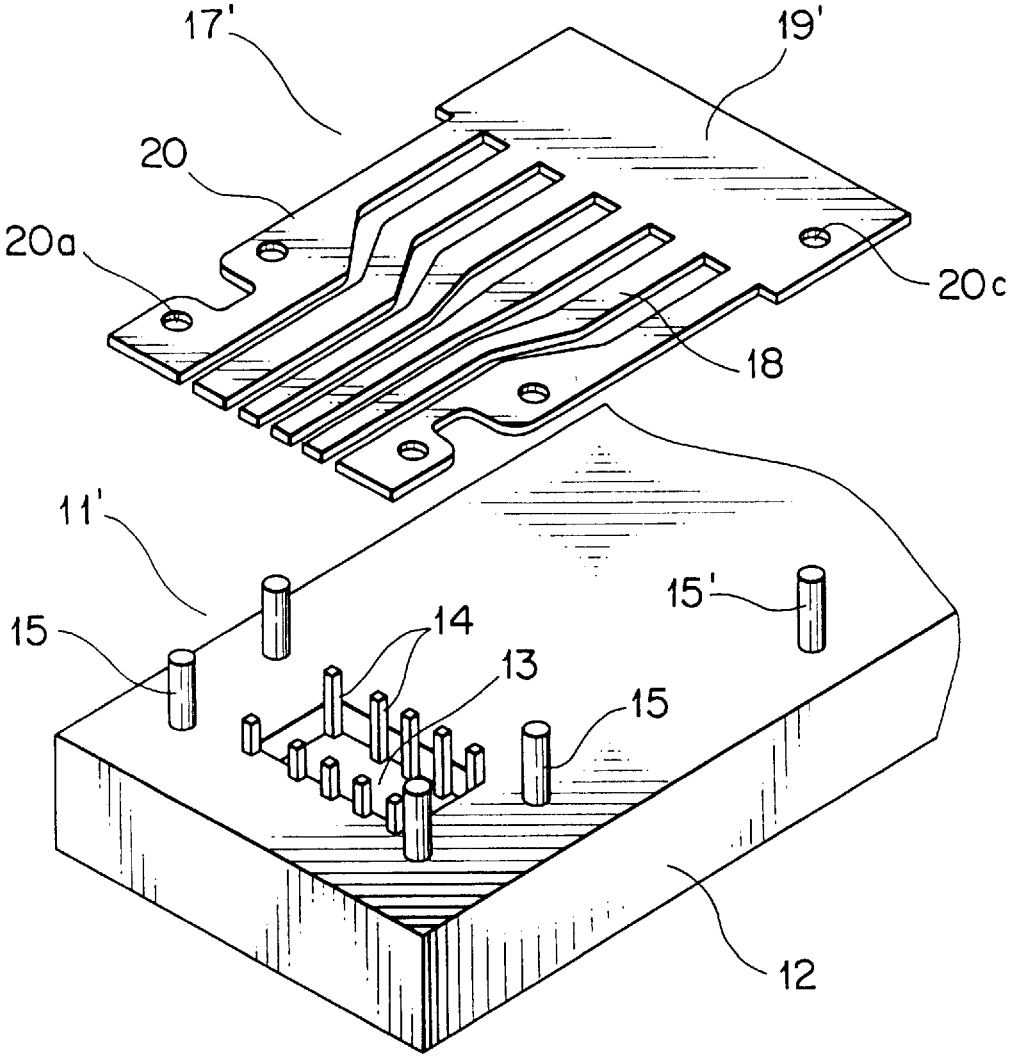
FIG. 17 is an explanatory view showing the next process of FIG. 16.

In FIG. 17, a jig 11' for forming a joint section comprises positioning pin 15' mounted upright on a jig main body 12 (FIG. 10). The link belt 19' of the terminal plate 17' is formed with a pin through-hole 20*c*.

Figure 18:
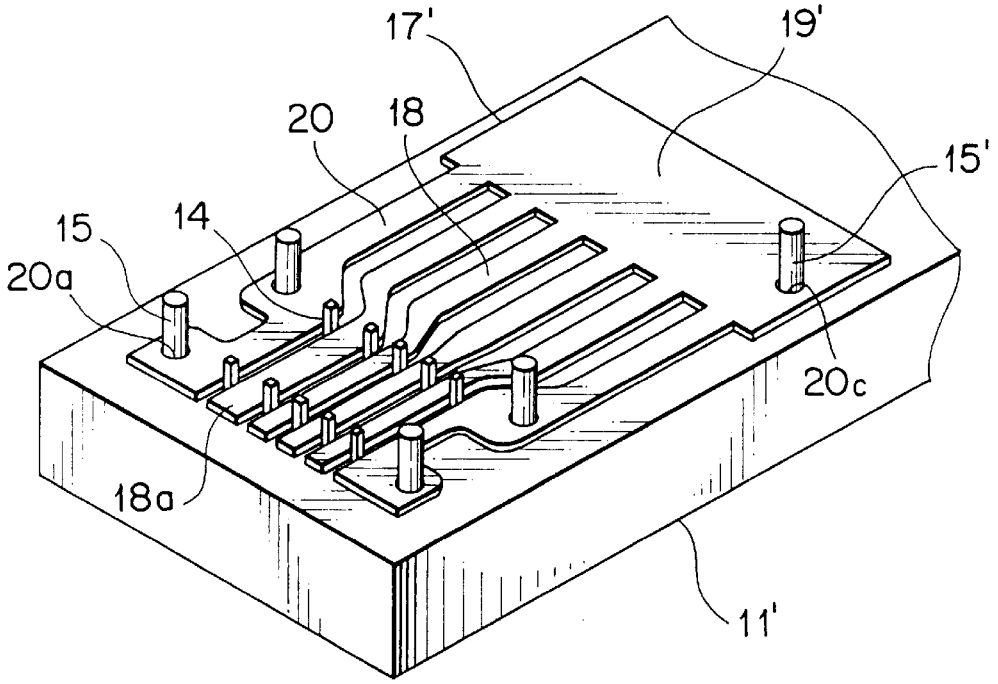
FIG. 18 is an explanatory view showing the next process of FIG. 17.

At first, as shown in FIG. 18, the pin through-holes 20*a* and 20*c* of the terminal plate 17' are adjusted on and received respectively by the positioning pins 15 and 15' so as to separate the end portions 18*a* of the joint terminals 18 from the respective adjacent one by the plurality of auxiliary pins 14, whereby the terminal plate 17' is properly positioned as shown in FIG. 18.

Figure 19:
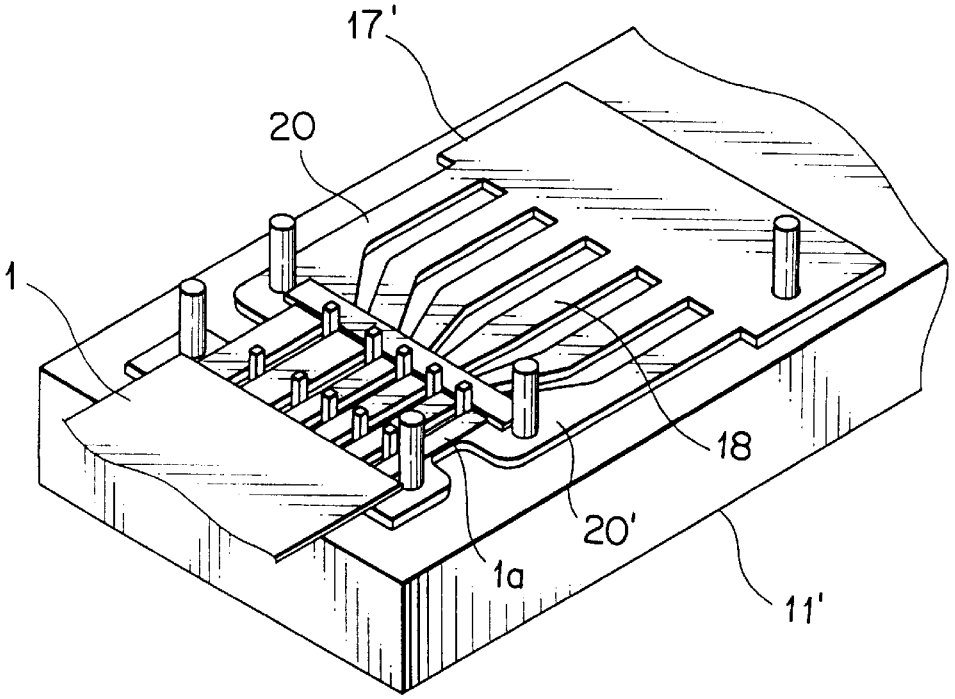
FIG. 19 is an explanatory view showing the next process of FIG. 18.
Figure 20:
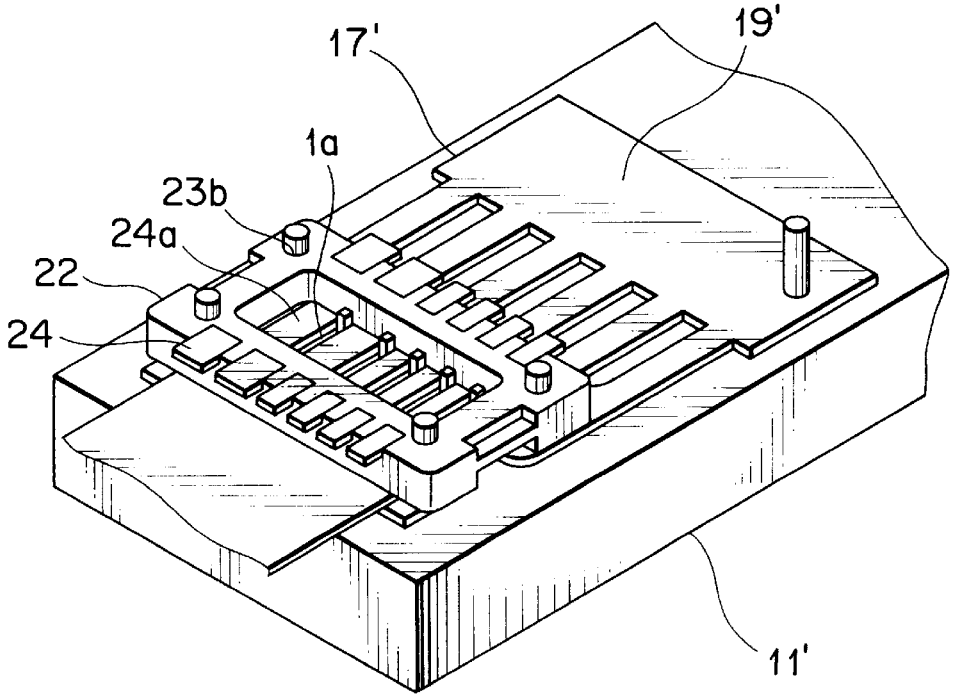
FIG. 20 is an explanatory view showing the next process of FIG. 19.

Secondly, as shown in FIG. 19, each of the conductive lines of the flat cable is piled on one end of the corresponding one of the joint terminals 18 (20, 20'), and thereafter, as shown in FIG. 20, the pin through-holes 23*b* of the auxiliary holder 22 are adjusted on and received by the positioning pins 15 to superpose the connecting plate 24*a* of each of the auxiliary terminals 24 on the corresponding one of the conductive lines 1*a*, and thereafter, an ultra-sonic wave welding operation is conducted on to the thus superposed three layers formed of the conductive lines 1*a*, connecting plates 24*a* of the auxiliary terminals 24, and the joint terminals 18 (20, 20').

Figure 21:
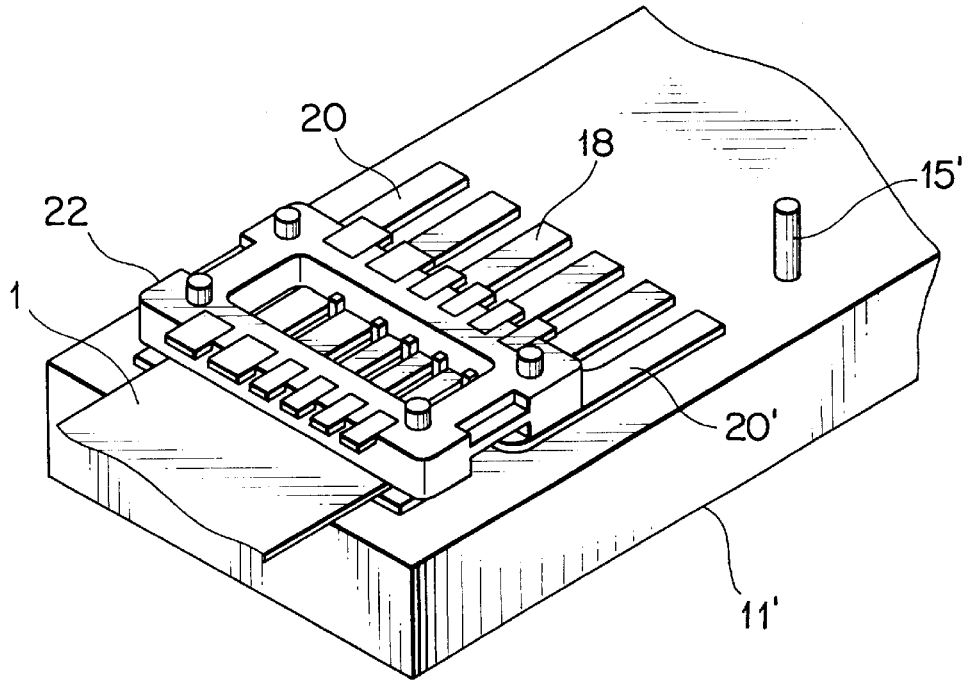
FIG. 21 is an explanatory view showing the next process of FIG. 20.

Thirdly, as shown in FIG. 21, the link belt 19' is cut away from the terminal 17', and thereafter as shown in FIG. 16, on the same surface with the other end portions 18*b* of the respective joint terminals 18 (20, 20') and the conductive lines 1*a* of the flat cable 1, the conductive lead lines 6*a* of the respective lead lines 6 are placed, and an ultra-sonic wave welding operation is conducted so as to form the joint section C1.

Figure 22:
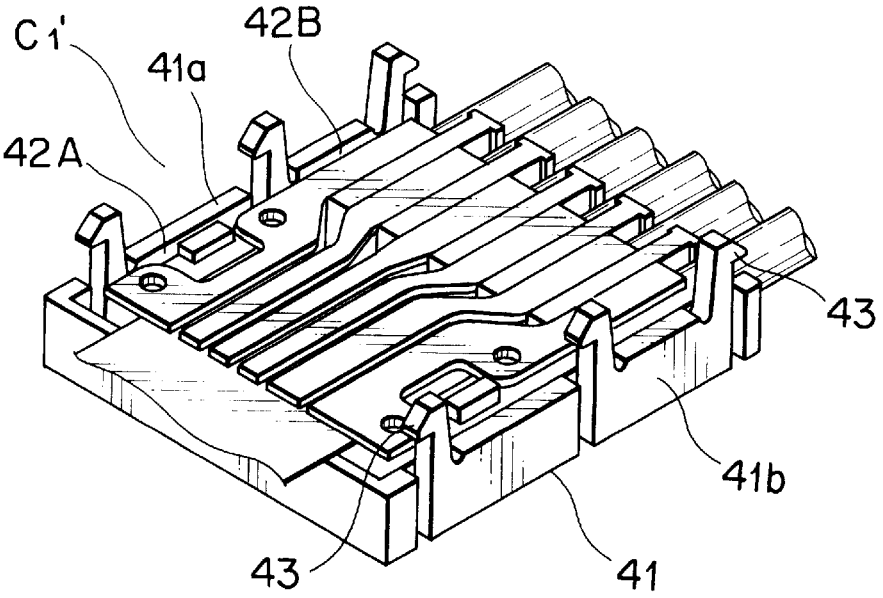
FIG. 22 is an explanatory view showing the next process of FIG. 21.
Figure 23:
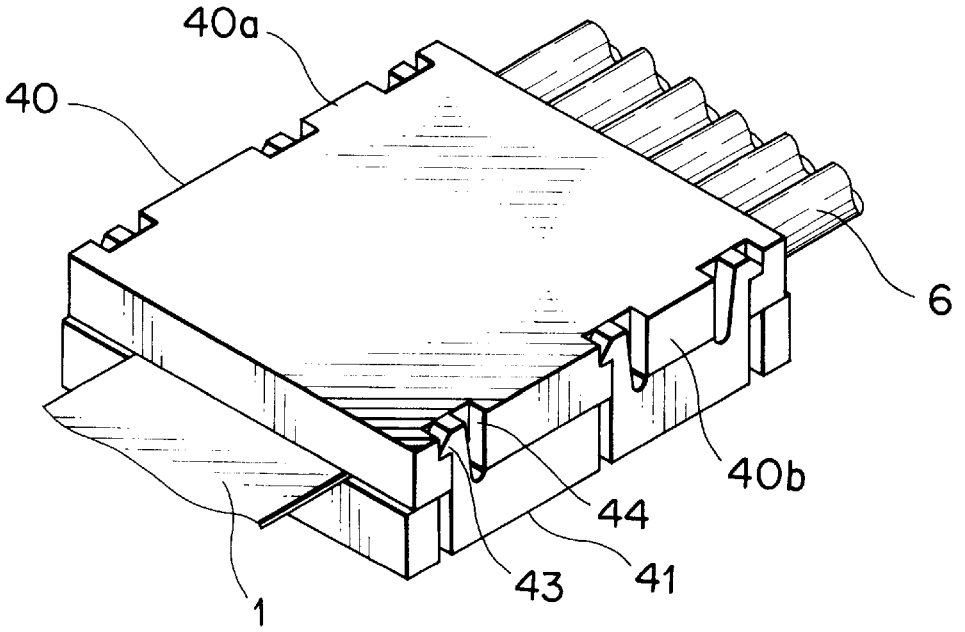
FIG. 23 is an explanatory view showing the last process of the same.
Figure 24:
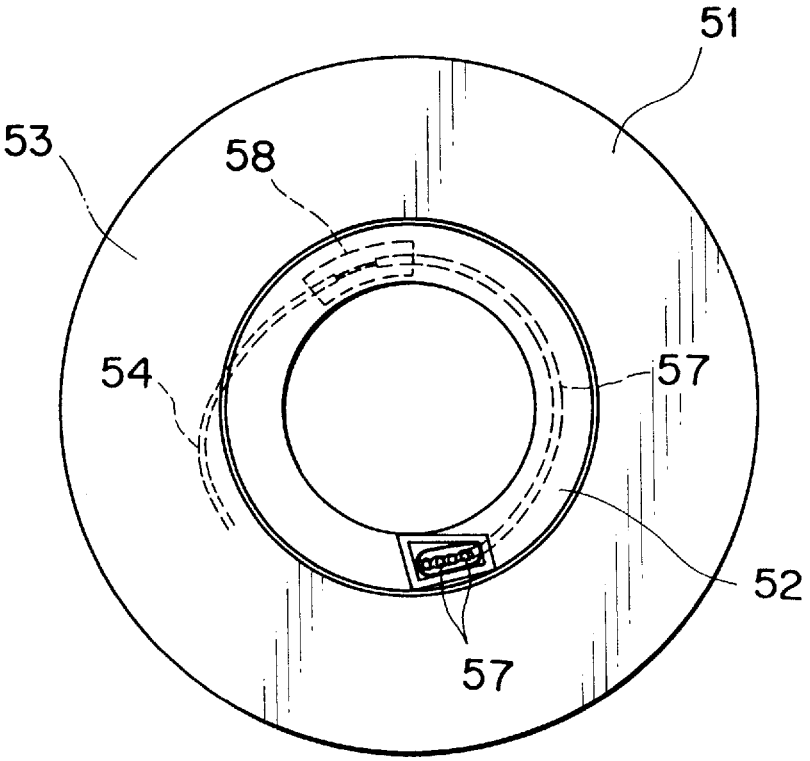
FIG. 24 PRIOR ART
FIG. 24 is a plain view showing one example of a conventional signal transmitting apparatus for a steering mechanism of a vehicle.
Figure 25A:
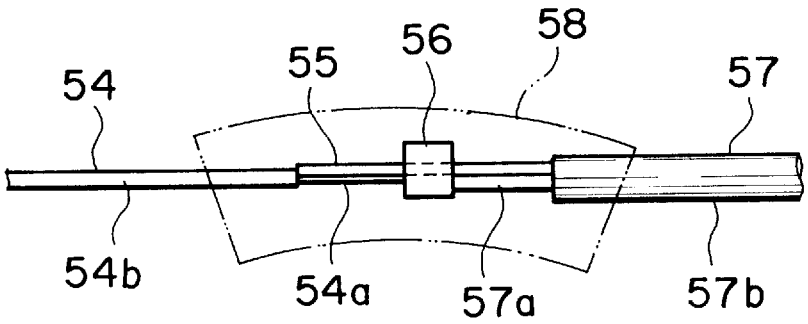
FIG. 25A PRIOR ART
FIG. 25A is a side view showing a joint section between the flat cable and the lead shown in FIG. 24.
Figure 25B:
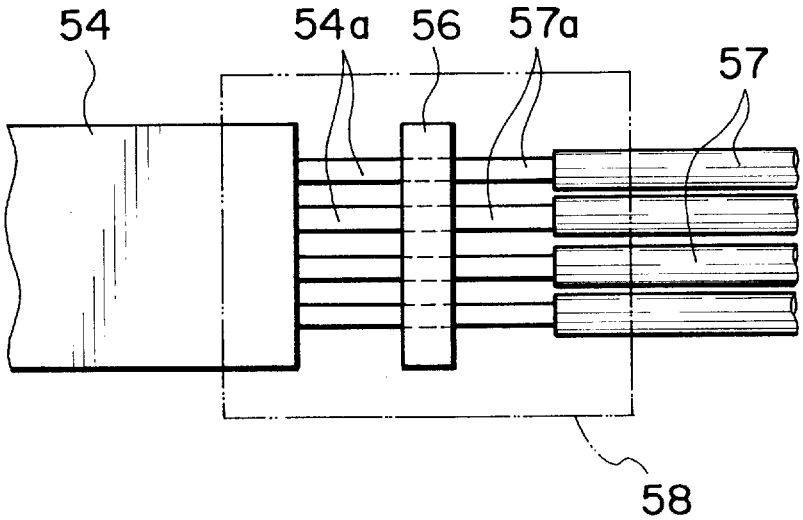
FIG. 25B PRIOR ART
FIG. 25B is a bottom view thereof.
Figure 25C:
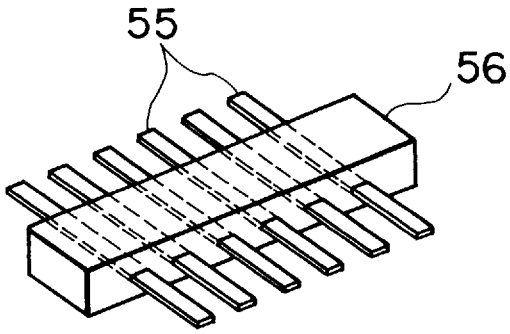
FIG. 25C PRIOR ART
FIG. 25C is a perspective view showing a relation between the joint bars and the electrically insulating holder.
Figure 26:
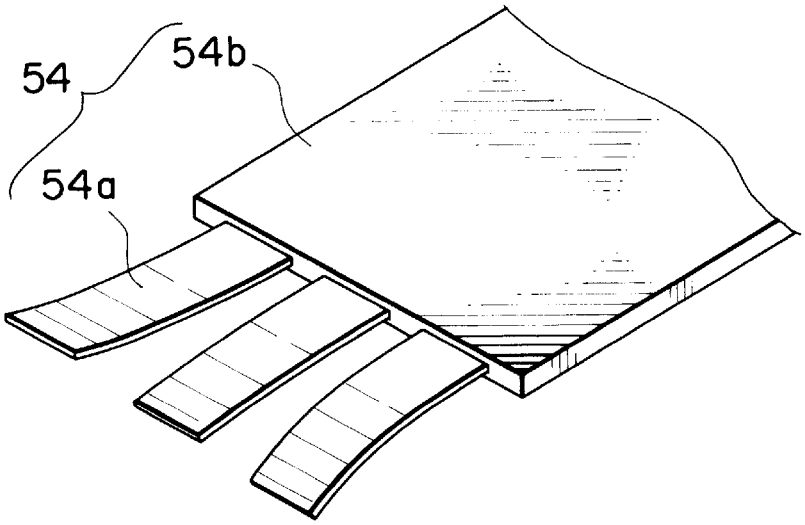
FIG. 26 PRIOR ART
FIG. 26 is a magnified view of the important portion of a conventional flat cable.
Figure 27:
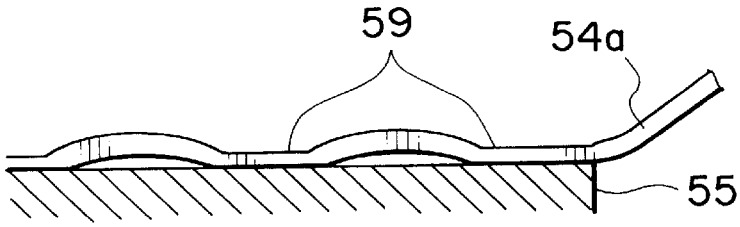
FIG. 27 PRIOR ART
FIG. 27 is a magnified explanatory view showing the joint section of the flat cable and the joint bar.
Figure 28:
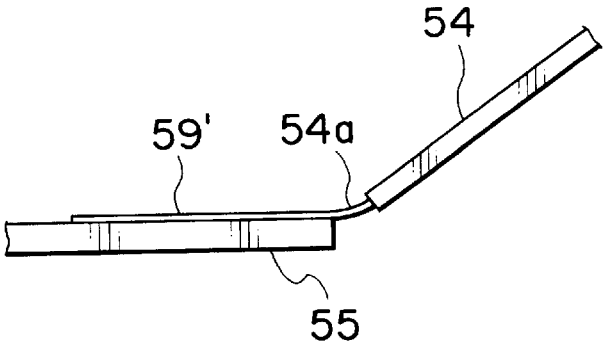
FIG. 28 PRIOR ART
FIG. 28 is an explanatory view showing a shape of the joint section between the flat cable and the joint bar.

Finally, as shown in FIG. 22, the thus formed joint section is put upside down (which state is referred to C1') to be set and fixed on the lower casing 41, on which a holder accommodating section 42A for accommodating the auxiliary terminal holder 22 and a lead accommodating section 42B for receiving the conductor 6*a* of the respective lead wires 6 thereon are individually formed. Thereafter, the upper casing 40 is fitted onto the joint section C1' as shown in FIG. 23, to intersect the joint section C1' between the upper casing 40 and the lower casing 41. Then, a plurality of upward projections formed on the respectively facing side walls 41*a* and 41*b* of the lower casing 41 and a plurality of locking recesses formed on the respectively facing side walls 40*a* and 40*b* of the upper casing 40 are fitted and locked to each other, thereby to firmly fix the upper and lower casings 40 and 41.

It is to be noted that although these casings 40 and 41 are formed in a rectangular shape in the present embodiment, they can possibly be formed in other shapes. Further, The fitting means to fix together the upper and lower casings 40 and 41 can also be other than the above locking means, and still further, although in the present embodiment the joint section C1 is first placed upside down to be set in the lower casing 41 and then the upper casing 40 is fitted on to the lower casing 41, it is also possible to intersect the joint section C1 without turning it between the upper and lower casings 40 and 41 to protect it.

Since the above joint section C1 is strong enough, there is no need to form it with the insulating resin insert molding method. By this, as the insert molding operation can be omitted, the joint section C1 can be easily handled, and the joint section C1 can thus be intersected by the upper and lower casings in a constant assembling line, thereby to reduce the manufacturing process and its total manufacturing cost. Further, as an insert molding operation is omitted, there will be no molding force applied to the joint section C1, and thus the mechanical strength thereof is not deteriorated. Due to this fact, there will be no disconnection between the joint terminals 18 (20, 20') and the conductive lines 1*a* of the flat cable 1, or between the joint terminals and the conductor 6*a* of the respective lead wires 6, thereby to raise the reliability of the manufactured joint section C1.

As explained heretofore, according to the present invention, since a flat cable to be connected with a plurality of lead wires is formed as a connecting terminal, a joint section between the flat cable and the lead wires obtained will be of a good operability for later processes, a protection of high level, and of a high reliability of mechanical and/or electrical connection. Further, the present invention can provide a joint section between the flat cable and lead wires, wherein the thickness of each conductive line of the flat cable is only 30 $\mu$m.

Still further, in the event that the joint section is not molded with the insulating resin by an insert molding operation, but intersected by the upper and lower casings instead, there will be no molding pressure normally generated on insert molding operations applied to the joint section, and thereby no deterioration is caused to the joint section, so that there will be no disconnection caused either between each of the joint terminals and the corresponding one of the conductive lines of the flat cable, or between each of the joint terminals and the corresponding one of the conductors of the respective lead wires, thereby to raise the reliability of the manufactured joint section C1.

Still further, as there is no need to prepare a separate process for molding the joint section by an insert molding operation, the joint section can be easily handled, whereby the joint section can be intersected by the upper and lower casings in a constant assembling line, thereby to reduce the manufacturing process and its total manufacturing cost.

Still in addition, since each of the conductive lines of the flat cable and the corresponding one of the conductors of the respective lead wires are welded on the same surface with that of the joint terminals, and since the joint section is intersected between the upper and lower casings for its protection, the product itself can be made considerably thin and compact.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A joint section comprising:

a flat cable having a plurality of conductive lines which are connected to a plurality of lead wires via a plurality of joint terminals, wherein a first end of each joint terminal of said plurality of joint terminals is formed in compliance with a pitch between said plurality of conductive lines which are mutually adjacent to each other, and a second end of each joint terminal of said plurality of joint terminals is formed in compliance with a pitch between said plurality of lead wires which are mutually adjacent to each other, each conductive line of said plurality of conductive lines of said flat cable is welded so as to be fixed between said first end of one of said plurality of joint terminals and an auxiliary terminal, of a plurality of auxiliary terminals, placed one on each conductive line of said plurality of conductive lines, and said second end of each joint terminal of said plurality of joint terminals being connected with a conductor of one of said plurality of lead wires.

2. The joint section as claimed in claim 1, wherein an insulating layer is left at a tip end portion of each conductive line of said plurality of conductive lines of said flat cable, each conductive line of said plurality of conductive lines being mutually linked to each other by said insulating layer.

3. The joint section as claimed in claim 1 or 2, wherein said plurality of conductive lines of said flat cable are connected to said plurality of joint terminals and said plurality of auxiliary terminals to form said joint section which is comprehensively covered by an insert molded body over said flat cable and said plurality of lead wires at opposite ends of said joint section.

4. The joint section as claimed in claim 1, wherein each joint terminal of said plurality of joint terminals is formed in an L-shape which is composed of a flat face terminal section at said first end to be welded to each conductive line of said plurality of conductive lines of said flat cable, and a circuit board connecting terminal section at said second end which is vertically bent downwardly from said flat face terminal section, wherein said circuit board connecting terminal section makes electrically conductive contact with one of said plurality of lead wires via a pattern formed on a circuit board.

5. A joint section connecting a flat cable having a plurality of conductive lines with a plurality of lead wires, said joint section comprising:

a plurality of joint terminals, wherein each joint terminal of said plurality of joint terminals has first and second ends with said first ends being formed in compliance with a pitch between said conductive lines of said flat cable with said conductive lines being adjacent each other, and said second ends being formed in compliance with a pitch between said lead wires with said lead wires being adjacent each other;

an auxiliary terminal holder which is formed by mutually connecting a plurality of auxiliary terminals by an insulating body in compliance with a pitch between said conductive lines;

a casing having a holder accommodating section at a first end thereof, and both a joint terminal placing section and a plurality of lead wire locking sections located at a second end thereof;

wherein each of said conductive lines at a first end of said flat cable is welded in such a state so as to be held between a first end of a corresponding one of said first ends of said plurality of joint terminals and a first end of a corresponding one of said plurality of auxiliary terminals of said auxiliary terminal holder and accommodated within said casing, and a conductor of each of said lead wires locked at a corresponding one of said lead wire locking sections of said casing, is connected with a second end of a corresponding one of said plurality of joint terminals.

6. The joint section as claimed in claim 5, wherein said flat cable, said plurality of joint terminals, said auxiliary terminal holder, said lead wires, and said casing are coated comprehensively by an insert molded body, including insulating layers of said flat cable and said plurality of lead wires.

7. The joint section as claimed in claim 1 or 2, wherein said joint section is accommodated within an upper casing and a lower casing, said upper casing and said lower casing being coupled to each other by coupling means.

8. A joint section for connecting a flat cable to both a plurality of lead wires and a plurality of joint terminals, wherein said flat cable has a plurality of conductive lines, said joint section comprising:

each joint terminal of said plurality of joint terminals having a first end formed in compliance with a pitch between adjacent pairs of conductive lines of said plurality of conductive lines of said flat cable which are adjacent to each other, and a second end formed in compliance with a pitch between adjacent pairs of lead wires of said plurality of lead wires which are adjacent to each other;

an auxiliary terminal holder which is formed by mutually connecting a plurality of auxiliary terminals via an insulating body in compliance with a pitch between adjacent conductive lines of said plurality of conductive lines which are adjacent to each other; and an upper casing and a lower casing, each separately provided with a holder accommodating section at a first end thereof, and each separately provided with a lead wire accommodating section at a second end thereof, and said upper casing being coupled to said lower casing by coupling means, wherein each of said conductive lines of said flat cable is welded to be fixed between said first end of one of said plurality of joint terminals and one of said plurality of auxiliary terminals, and a conductor of each of said plurality of lead wires is welded to said second end of each of said plurality of joint terminals on a side of a surface where each of said plurality of conductive lines of said flat cable are welded, and wherein a joint portion of said conductor of each of said plurality of lead wires is positioned between said upper casing and said lower casing.

* * * * *